United States Patent [19]

Holtermann et al.

[11] Patent Number: 4,719,881

[45] Date of Patent: Jan. 19, 1988

[54] OIL METERING DEVICE FOR SUPPLYING OIL TO A FUEL TANK

[75] Inventors: Theodore J. Holtermann, Milwaukee; William F. Ziehm, Wauwatosa, both of Wis.

[73] Assignee: Outboard Marine Corporation, Waukegan, Ill.

[21] Appl. No.: 687,870

[22] Filed: Dec. 31, 1984

[51] Int. Cl.[4] ..... F02B 33/04

[52] U.S. Cl. ..... 123/73 AD; 123/196 R

[58] Field of Search ..... 123/73 AD, 196 R, 73 AB; 137/99; 417/418

[56] References Cited

U.S. PATENT DOCUMENTS

| | | | |
|---|---|---|---|
| 1,577,157 | 3/1926 | Averill | 123/73 AD |
| 3,345,997 | 10/1967 | Miller | 137/99 |
| 4,312,595 | 1/1982 | Houseman | 366/153 |
| 4,381,941 | 5/1983 | Walsworth | 123/73 AD |
| 4,617,879 | 10/1986 | Mori | 123/73 |

FOREIGN PATENT DOCUMENTS

| | | | |
|---|---|---|---|
| 517635 | 2/1940 | United Kingdom | 464/25 |

*Primary Examiner*—Carl Steuart Miller

*Attorney, Agent, or Firm*—Michael, Best & Friedrich

[57] ABSTRACT

A fuel tank includes a first container adapted to contain a fuel mixture, and a second container adapted to contain oil. A metering arrangement is provided for selectively delivering a measured quantity of said oil from the second container to the first container when fuel is added to the first container. The volume of the oil delivered to the first container being proportional to the volume of fuel added to the first container. A valve assembly is also provided for alternatively providing fluid communication between a metering chamber and the first container and the metering chamber and the second container and for permitting oil flow to the first container only when the fuel tank cap is removed.

22 Claims, 10 Drawing Figures

OIL METERING DEVICE FOR SUPPLYING OIL TO A FUEL TANK

FIELD OF THE INVENTION

The invention relates generally to fuel tanks for two cycle engines such as those used in lawn mowers or marine propulsion units and more particularly to means for automtically mixing a suitable quantity of oil with gasoline added to the fuel tank.

BACKGROUND PRIOR ART

In two-cycle engines of the type employed in lawn mowers and outboard engines, oil is mixed with gasoline in the appropriate amounts by manually adding a measured quantity of oil to the fuel tank at the time that the gasoline is added to the tank.

As described in the Walworth U.S. Pat. No. 4,381,741, issued May 3, 1983, some two-cycle outboard engines also include two separate containers, one for gasoline and one for oil, and means are also provided for pumping gasoline and oil to the engine where they are mixed in suitable proportions and then fed directly to the combustion chambers of the engine.

Attention is also directed to an apparatus for mixing scale reducing chemicals with water added to a boiler illustrated in the Averill U.S. Pat. No. 1,577,157 issued Mar. 16, 1926.

Attention is further directed to the Houseman et al. U.S. Pat. No. 4,312,595 issued Jan. 26, 1982; the Miller et al. U.S. Pat. No. 3,345,997 issued Oct. 10, 1967 and the British Patent No. 517,635 dated July 31, 1937.

SUMMARY OF THE INVENTION

The present invention provides an apparatus for mechanically mixing oil with gasoline in a fuel tank when gasoline is added to the fuel tank, and the oil is added in a measured amount depending on the quantity of gasoline added to the fuel tank.

More particularly the invention includes a tank for use in containing a liquid mixture, the tank including a first container adapted to contain the liquid mixture, the first container including an inlet opening adapted to receive a first liquid. The tank also includes a second container adapted to contain a second liquid, and means are further provided for selectively delivering a measured quantity of the second liquid from the second container to the first container when the first liquid is added to the first container, and such that the volume of the second liquid delivered to the first container is proportional to the volume of the first liquid added to the first container. The means for selectively delivering a measured quantity of the second liquid to the first container includes means defining a metering chamber and means for alternatively providing fluid communication between the metering chamber and the first container and the metering chamber and the second container.

The invention also includes a fuel tank including a first container adapted to contain a fuel mixture and including an inlet opening adapted to receive fuel, and a second container adapted to contain a second liquid. Means are further provided for selectively delivering a measured quantity of the second liquid from the second container to the first container when fuel is added to the first container with the volume of the second liquid delivered to the first container being proportional to the volume of fuel added to the first container.

In one embodiment of the invention the means for selectively delivering a measured quantity of the second liquid to the first container includes means defining a metering chamber and means for alternatively providing fluid communication between the metering chamber and the first container and between the metering chamber and the second container.

In one embodiment of the invention the means for selectively delivering a measured quantity of the second liquid includes a float housed in the first container, a piston housed in the metering chamber, and means for operably connecting the float to the piston to cause reciprocal movement of the piston in the metering chamber in response to vertical movement of the float.

In one embodiment of the invention the means for operably connecting the float to the piston includes a first lever arm having opposite ends, one of the opposite ends being fixed to the float and the other of the opposite ends being pivotably supported. A second layer arm is fixed to the first lever arm for pivotal movement with the first lever arm, and means are also provided for connecting the second lever arm to the piston for causing reciprocal movement of the piston in response to vertical movement of the float.

In one form of the invention the fuel tank includes a fuel tank cap for removably closing the inlet opening, and the means for alternatively providing fluid communication includes valve means including a valve member supported for movement between a first position and a second position. Means are further provided for moving the valve member to the first position when the fuel tank cap closes the inlet opening and for moving the valve member to the second position when the fuel tank cap is removed from the inlet opening.

In one form of the invention the valve means provides fluid communication between the metering chamber and the second container when the valve member is in the first position and provides fluid communication between the metering chamber and the first container when the valve member is in the second position.

In one form of the invention the means for moving the valve member includes a sleeve housed in the inlet opening and supported therein for vertical reciprocal movement between a first position and a second position. Spring means are compressed between a portion of the sleeve and the first container, and the spring means bias the sleeve toward the second position. The valve member is supported for movement with the sleeve such that the valve member is in the valve member first position when the sleeve is in the sleeve first position, and the valve member is in the valve member second position when the sleeve is in the sleeve second position.

In one embodiment of the invention the valve means is a spool valve including a valve spool supported for reciprocal movement, and the valve spool is fixed to the sleeve for movement with the sleeve.

In one embodiment of the invention the means for alternative providing fluid communcation includes a first valve for selectively connecting the metering chamber to the first container and a second valve for selectively connecting the metering chamber to the first container. The second valve means comprises a valve member supported for rotation about an axis, and rack and pinion means are provided for causing selective rotation of the valve member.

One of the advantages of the invention is that the apparatus provides a convenient means for adding oil to fuel in a fuel tank in carefully controlled amounts, and the operator does not have to measure the oil added to the fuel tank or manually add the oil to the fuel. Additionally, the apparatus embodying the invention can include an oil reservoir having the capacity to hold a sufficient amount of oil so that the fuel tank can be filled several times without the addition of oil to the oil reservoir.

Another of the advantages of the present invention is that the apparatus provides a mechanical means for injecting a proper amount of oil into the fuel added to the fuel tank regardless of the amount of gasoline added to the fuel tank.

Various other features and advantages of the invention will be apparent by reference to the following description of a preferred embodiment, from the drawings and from the claims.

Figure 1:
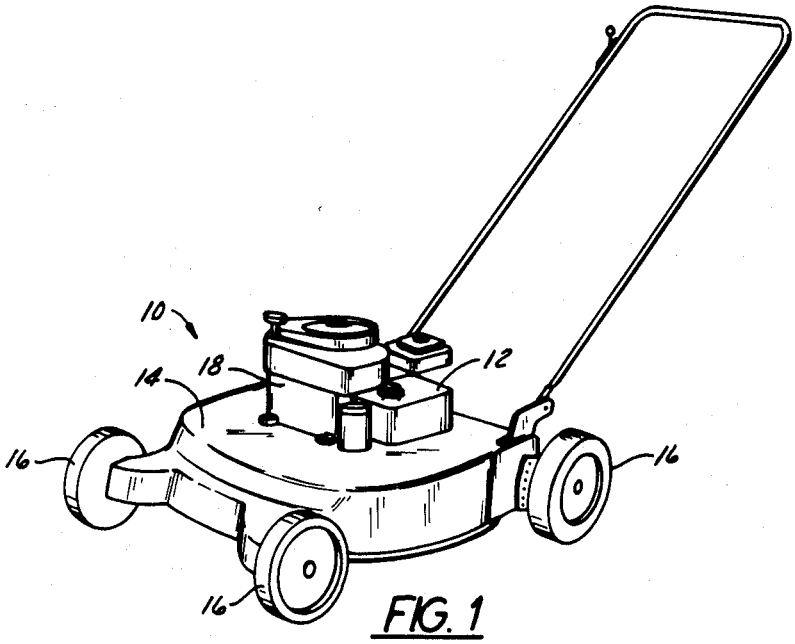
FIG. 1 is a perspective view of a lawn mower embodying the present invention.

Before describing a preferred embodiment of the invention in detail, it is to be understood that the invention is not limited in its application to the details of construction nor to the arrangement of the components set forth in the following description nor illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF THE PREFERRED EMBODIMENT

Illustrated in FIG. 1 is a lawn mower 10 including a fuel tank 12 embodying the present invention. The lawn mower 10 includes a blade housing 14 supported by a plurality of wheels 16 for movement along the ground. The blade housing supports an engine 18, and the fuel tank 12 is connected to the engine to supply fuel to the engine. It should be understood that while the fuel tank 12 is described as being operably embodied in a lawn mower, the fuel tank 12 could also be used to supply fuel to an outboard motor or comprise a fuel tank for use with other machines empoying a two-cycle engine. Additionally, while the illustrated tank 12 as described herein is adapted to contain a mixture of gasoline and oil, in other embodiments of the invention, the tank 12 could be used to contain other liquid mixture and provide a means for insuring mixing of suitable quantities of a liquid additive with a primary liquid.

The fuel tank 12 includes a first container 20 adapted to house a quantity of a primary liquid such as gasoline. The fuel tank 12 also includes a filling neck 22 defining an inlet opening to facilitate the addition of gasoline to the container 20. Means are also provided for selectively closing the inlet opening. While this means for closing could have various constructions, in the illustrated arrangement the filling neck 22 includes a threaded upper end and a conventional cap 24 is threaded onto the upper end of the filling neck 22.

The fuel tank 12 also includes a second container means. In the illustrated arrangement the second container means comprises an oil reservoir or tank 26 and a second filling neck 28 is provided to permit filling of the oil reservoir 26. A cap 30 is threaded onto the upper end of the oil reservoir filling neck 28. In a preferred form of the invention, the second container means is sized such that it can hold a sufficient quantity of oil so that the required quantity of oil can be mixed with fuel in the fuel tank several times before refilling of the second container or oil reservoir 26 is required.

While in the illustrated construction the second container or oil reservoir 26 is housed in the first container 20, in other arrangments the second container 26 can be outside of the first container 20 and communicate with the first container through conduits. Additionally, it should also be understood that the first container 20 and the oil reservoir 26 could be spaced apart or remote from one another.

Means are also provided for selectively delivering a measured quantity of oil to the first container 20 when gasoline is added to the first container and such that the volume of oil added to the first container 20 is proportional to the volume of fuel added to the first container. The means for selectively delivering oil to the first container 20 includes a metering chamber 32 housing a piston 34 supported for reciprocal movement. While the metering chamber 32 could have other constructions, in the illustrated arrangement it is defined by a cylinder, and the piston 34 includes a pair of circumferentially extending grooves housing resilient seals 36 to provide a fluid-tight sliding seal between the piston 34 and the wall of the metering chamber 32.

The means for selectively delivering oil to the first container 20 also includes means for alternatively connecting the oil reservoir 26 with the metering chamber 32 and the metering chamber 32 with the first container 20. This means includes a first conduit 38 for selectively connecting the oil reservoir 26 to the metering chamber 32 and a second conduit 40 selectively connecting the metering chamber 32 to the first container 20. Valve means are also provided for alternatively opening the first conduit 38 and closing the second conduit 40 or closing the first conduit 38 and opening the second conduit 40.

Figure 2:
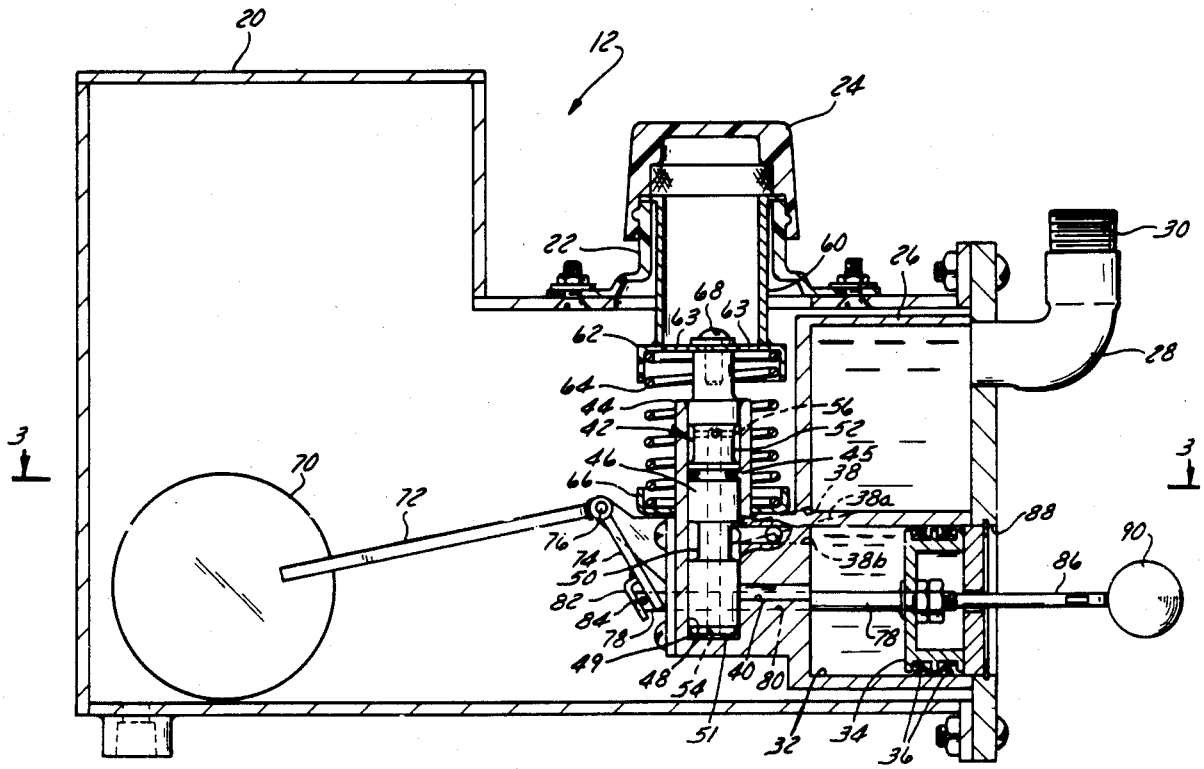
FIG. 2 is an enlarged cross section elevation view of the fuel tank of the lawn mower shown in FIG. 1.

While the valve means could have various constructions, in the arrangement illustrated in FIG. 2, the valve means comprises a spool valve 42 including a valve body 44 and a valve sppol 46. The valve body 44 includes a cylinder or bore 48 having a closed lower end 51 and being open at its upper end. An O-ring seal 45 surrounds the valve spool 46 and provides a seal with the bore 48. The valve spool 46 includes a pair of spaced apart circumferentially extending grooves 50 and 52. The valve spool 46 also includes a central longitudinally extending bore 54 extending from the lower end of the valve spool 46, the central longitudinally extending bore 54 having an upper end communicating with the upper groove 52 of the valve spool through radially extending bores 56.

Figure 3:
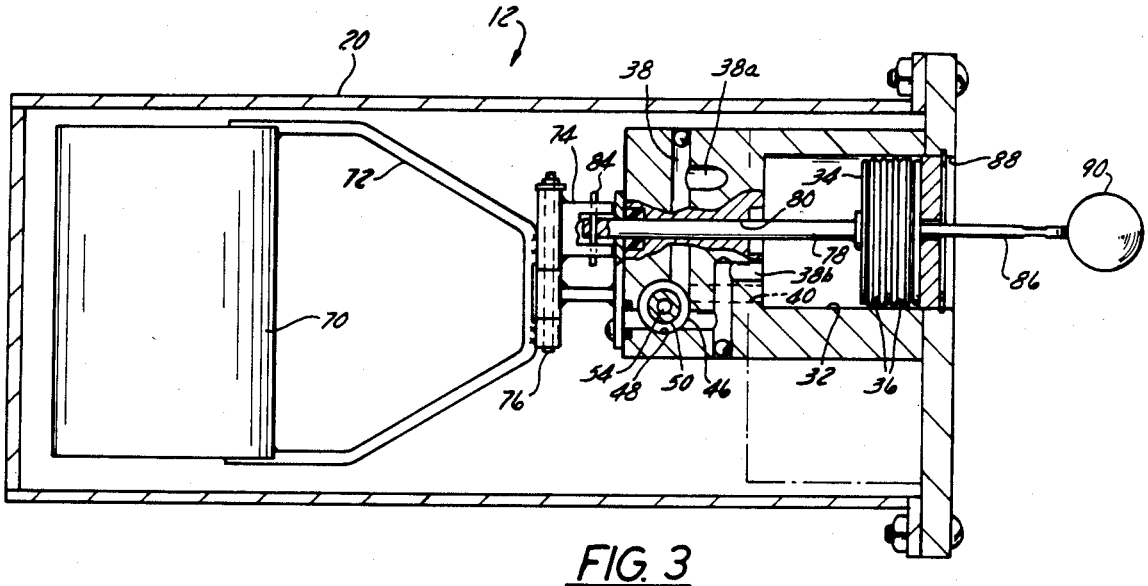
FIG. 3 is a cross section plan view of the fuel tank illustrated in FIG. 2 and taken along line 3—3 in FIG. 2.
Figure 4:
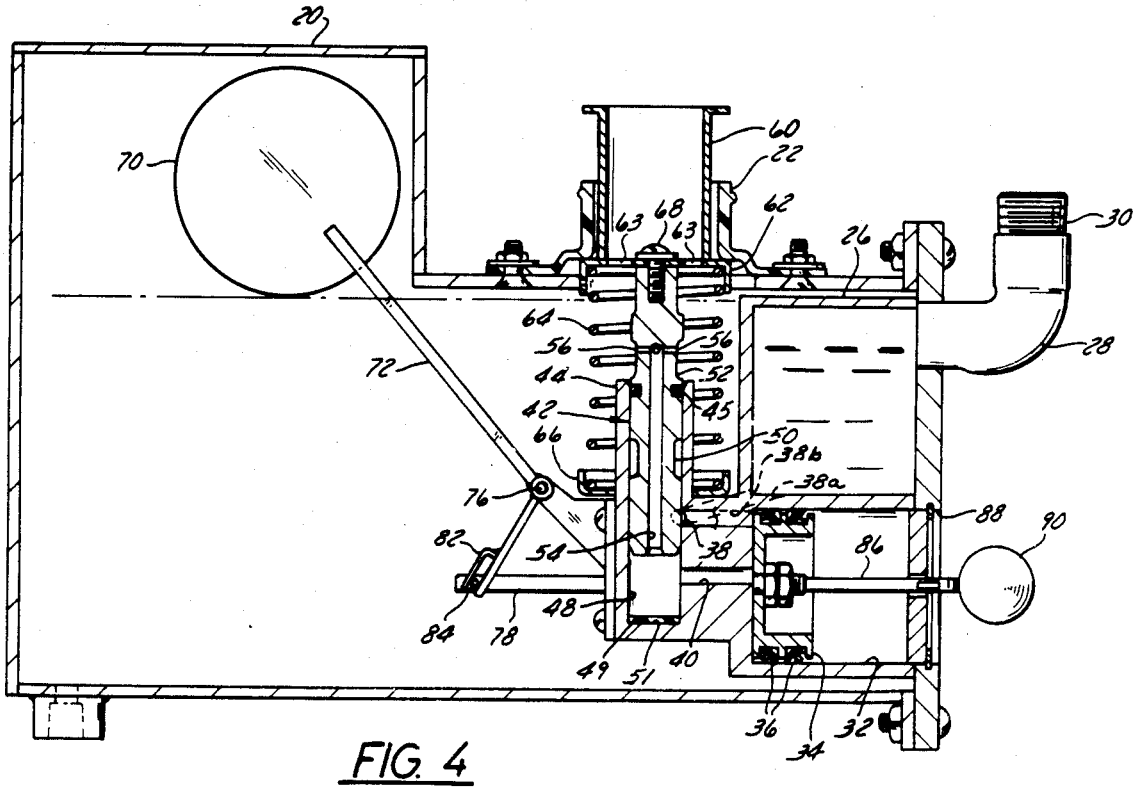
FIG. 4 is a view similar to that shown in FIG. 2 but showing the fuel tank cap removed and the fuel tank filled with fuel.

In the arrangement illustrated in FIGS. 2–4, the first conduit 38 is comprised of a first portion 38*a* which extends from the oil reservoir 26 to the valve bore 48 and a second portion 38*b* which extends from the valve bore 48 to the metering chamber 32. When the valve spool 46 is in the position shown in FIG. 2, the groove 50 in the valve spool 46 provides for fluid communication between the first and second portions 38*a* and 38*b* of the first conduit 38.

In the arrangement illustrated in FIG. 2 the second conduit 40 extends from the metering chamber 32 to a lower portion of the valve bore 48. When the valve spool 46 is in the position shown in FIG. 4, the conduit 40 communicates with the valve bore 48 and oil can flow from the metering chamber 32 through the second conduit 40 into the valve bore 48 and upwardly through the central longitudinally extending bore 54 and the radially extending bores 56 into the first container 20.

In operation of the spool valve 42, when the valve spool 46 is in the position shown in FIG. 2, the groove will provide fluid communication through the first and second portions 38*a* and 38*b* of the first conduit between the oil reservoir 26 and the metering chamber 32 and facilitate free flow of oil therebetween. The lower end of the valve spool 46 will block the second conduit 40 and prevent flow of fluid between the metering chamber 32 and the first container 20. A soft resilient washer 49 is also housed in the lower end of the valve bore 48 and prevents fluid flow through the central longitudinally extending bore 54 when the valve spool 46 is in the FIG. 2 position.

Means are also provided for causing movement of the valve spool 46 such that when the fuel tank cap 24, which is threaded onto the first container filling neck 22, is removed, the valve means 42 interrupts communication between the oil reservoir 26 and the metering chamber 32 and provides fluid communication between metering chamber 32 and the first container 20. While various means could be provided for causing movement of the valve spool 46 when the fuel tank cap 24 is removed, in the arrangement illustrated in FIGS. 2–4, a sleeve 60 is housed in the neck 22 and means are provided for supporting the sleeve 60 for vertical slideable movement in the neck 22. As shown in FIG. 2, the cylindrical tubular sleeve 60 has an outside diameter only slightly smaller than the inside diameter of the neck 22, but sufficiently small that the tubular sleeve 60 is freely slideably moveable within the neck. The means for supporting the tubular sleeve includes a circular end cap 62 secured to the lower end of the sleeve 60. A coil spring 64 is positioned beneath the end cap 62 and is compressed between the end cap 62 and a complementary flange 66 supported by the valve body. The coil spring 64 applies an upward force on the sleeve 60. The circular end cap 62 includes a plurality of openings 63 to permit flow of gasoline through the sleeve into the container 20.

In the construction illustrated, the upper end of the valve spool 46 is fixed to the end cap 62 by a screw 68 and is carried by the end cap 62 for vertical reciprocal movement with the sleeve 60 housed in the neck 22. When the fuel tank cap 24 is removed, the coil spring 64 forces the sleeve 60 and the valve spool 46 upwardly to the position interrupting fluid communication between the oil reservoir 26 and the metering chamber 32 and providing fluid communication between the metering chamber 32 and the first container 20.

Means are also provided for causing oil to be pumped or forced into the first container 20 from the metering chamber 32 in response to the addition of gasoline to the first container 20. This means for pumping oil into the first container 20 provides for a measured flow of oil and in amounts proportional to the amount of gasoline added to the first container 20. While this means could be constructed in various ways, in the illustrated arrangement it includes a float 70 housed in the first container 20. Means are also provided for connecting the float 70 to the piston 34 housed in the metering chamber 32 and to cause movement of the piston 34 so as to inject oil into the first container 20 in response to upward movement of the float 70. In the particular arrangement illustrated in FIG. 2 this means includes a lever arm 72 having one end fixed to the float 70, and the opposite end of the lever arm 72 is supported for pivotal movement so as to permit free vertical movement of the float 70. A second lever arm 74 is fixed to the pivoting end of the first lever arm 72 to form a bellcrank and pivots with the first lever arm 74 about a pivot pin 76 supporting the first lever arm. A piston rod 78 extends from the piston 34 through a bore 80 in the valve body into the first container 20. The lower end of the second lever arm 74 defines a fork 82 housing a pin 84 in the first container. The fork 82 and pin 84 provide a sliding connection between the piston rod 78 and the bellcrank defined by the first and second lever arms 72 and 74 so as to cause linear reciprocal movement of the piston rod 78 and the piston 34 in response to vertical movement of the float 70.

In operation of the apparatus illustrated in FIG. 3, when the cap 24 is removed and gasoline is added to the first container 20 thereby causing upward movement of the float 70, the bellcrank will pivot in a clockwise direction around the pivot pin 76 and the lower end or fork portion 82 of the second lever arm 74 will move to the left as seen in FIG. 3, thereby pulling the piston rod 78 and the piston 34 to the left. Such movement of the piston 34 causes oil to be forced from the metering chamber 32 into the first container 20. The amount of oil delivered to the first container 20 from the metering chamber 32 is dependent on the vertical movement of the float 70 since the amount of horizontal movement of the piston 34 is directly proportional to the amount of movement of the float 70. If only a portion of the first container 20 is filled, the piston 34 will force only a portion of the oil in the metering chamber 32 into the first container 20.

When the fuel tank cap 24 is in place on the neck 22 and thus the valve spool 46 is in the position shown in FIG. 2, the oil reservoir 26 and the metering chamber 32 are maintained in communcation with one another so that oil may move freely between the oil reservoir 26 and the metering chamber 32. Any movement of the fuel tank 12 causing vertical movement of the float 70 can cause reciprocal movement of the piston 34 such that the oil will flow back and forth between the oil reservoir 26 and the metering chamber 32.

In the particular arrangement illustrated in FIGS. 2–4, the apparatus further includes means for indicating the position of the piston 34 in the metering chamber. This means comprises a rod 86 fixed to the piston 34 and extending through a bore 88 from the fuel tank 12. A knob 90 is positioned on the end of the rod 86 and is thereby fixed to the piston 34 so as to move toward and away from the sidewall of the container 20 in response to movement of the piston 34 in the metering chamber 32. Since the piston 34 is fixed to the float 70 and is moveable in response to movement of the float 70, the knob 90 functions as an indicator of the fuel level in the fuel tank 12.

FIGS. 5–9 illustrate an alternative embodiment of the invention. The construction shown there includes a fuel tank 112 for use with a two-cycle engine and defining a first fuel container or tank 120 adapted to contain a mixture of gasoline and including a threaded filling neck 122 adapted to be closed by a threaded cap 124. The fuel tank houses a second container 126 adapted to contain a supply of oil to be mixed in the fuel tank 112 with gasoline. Also contained within the fuel tank 112 is a cylindrical metering chamber 130 for containing oil supplied by the second container 126. A piston 134 is housed in the metering chamber 130 and provides a means for forcing measured quantities of oil into the first container 120 to be mixed with gasoline therein.

Means are also provided for causing reciprocal movement of the piston 134 in the metering chamber 130 in response to movement of a float 170 housed in the first container 120. A bellcrank comprised of a first lever arm assembly 172 and a second lever arm assembly 174 is supported by a pair of brackets 175 for relatively free pivotal movement about a horizontal pivot axis. A free end of the first lever arm assembly 172 is connected to the float 170 and is carried by the float for vertical movement. More specifically, the first lever arm assembly 172 is comprised of a pair of a spaced apart arms 171 joined by a connecting rod 173. In the illustrated arrangement of FIGS. 5–9, the brackets 175 extend from the oil reservoir 126, and the integral molded part of the reservoir 126, and the brackets 175 include aligned bores housing the connecting rod 173. Free ends of the spaced apart arms 171 engage the float 170 therebetween, and the connecting rod 173 is supported by the brackets 175 for free pivotal movement about the longitudinal axis of the connecting rod. A piston rod 178 is connected to the piston 134 and includes an end 179 defining a generally vertically extending slot 181. The second lever arm assembly 174 is comprised of a pair of arms, the free ends of these arms supporting a roller 183 which is, in turn, housed in the slot 181 in the piston, and the roller 183 is freely vertically moveable in that slot.

In the construction illustrated in FIGS. 5 through 9, a first conduit 138 provides fluid communication between the oil reservoir 126 and the metering chamber 130 and a second conduit 140 provides for flow of oil from the metering chamber 130 into an upper part of the fuel tank 120.

As in the embodiment of the invention shown in FIGS. 5–9 means are also provided for selectively preventing oil flow from the metering chamber 130 into the fuel tank 120 when the fuel cap 124 is in place on the neck 122 and for permitting oil flow from the metering chamber 130 into the fuel tank 120 when the cap 124 is removed from the neck 122. This means includes a rotary valve assembly 142 (FIGS. 7, 8 and 9) including a valve member 144 housed in a valve bore 146 and supported for rotation between a first position shown in FIG. 9 and a second position shown in FIG. 8. In the FIG. 9 position, fluid communication is provided through passages **138*a* and 138*b* between the metering chamber 130 and the oil reservoir 126, and fluid communication between the metering chamber 130 and the second conduit 140 is prevented. In the FIG. 8 position fluid communication between the metering chamber 130 and the oil reservoir 126 is prevented, and the metering chamber 130 and the second conduit 140 are placed in fluid communication. This means for selectively preventing oil flow from the metering chamber 130 into the fuel tank 120 when the fuel cap 124 is in place on the neck 122 and for permitting oil flow from the metering chamber 130 into the fuel tank 120 when the cap 120 is removed also includes a vertically reciprocable sleeve 160 housed in the filler neck 122 and supported therein for slidable movement between a lower position shown in FIG. 5 and the raised position shown in FIG. 6. The sleeve 160 includes a central bore 163 to provide for flow of fuel into the container 120. The upper end of the sleeve 160 is surrounded by a peripheral flange 162 and an internal shoulder 166 is provided in the lower portion of the filler neck 122. A compression spring 164 is provided between the flange 162 and the shoulder 166 and biases the sleeve 160 toward the raised position shown in FIG. 6**.

Figure 5:
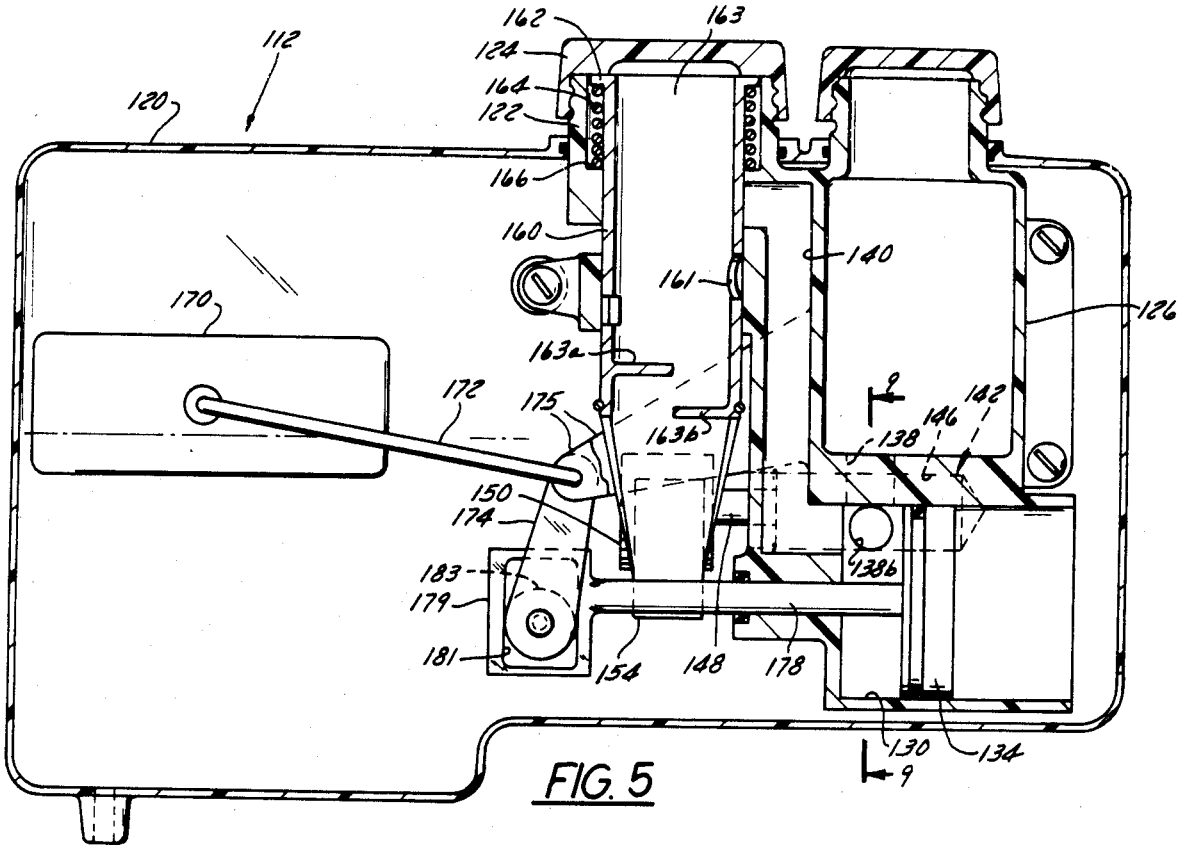
FIG. 5 is a view similar to FIG. 2 but showing an alternative embodiment of the fuel tank.
Figure 6:
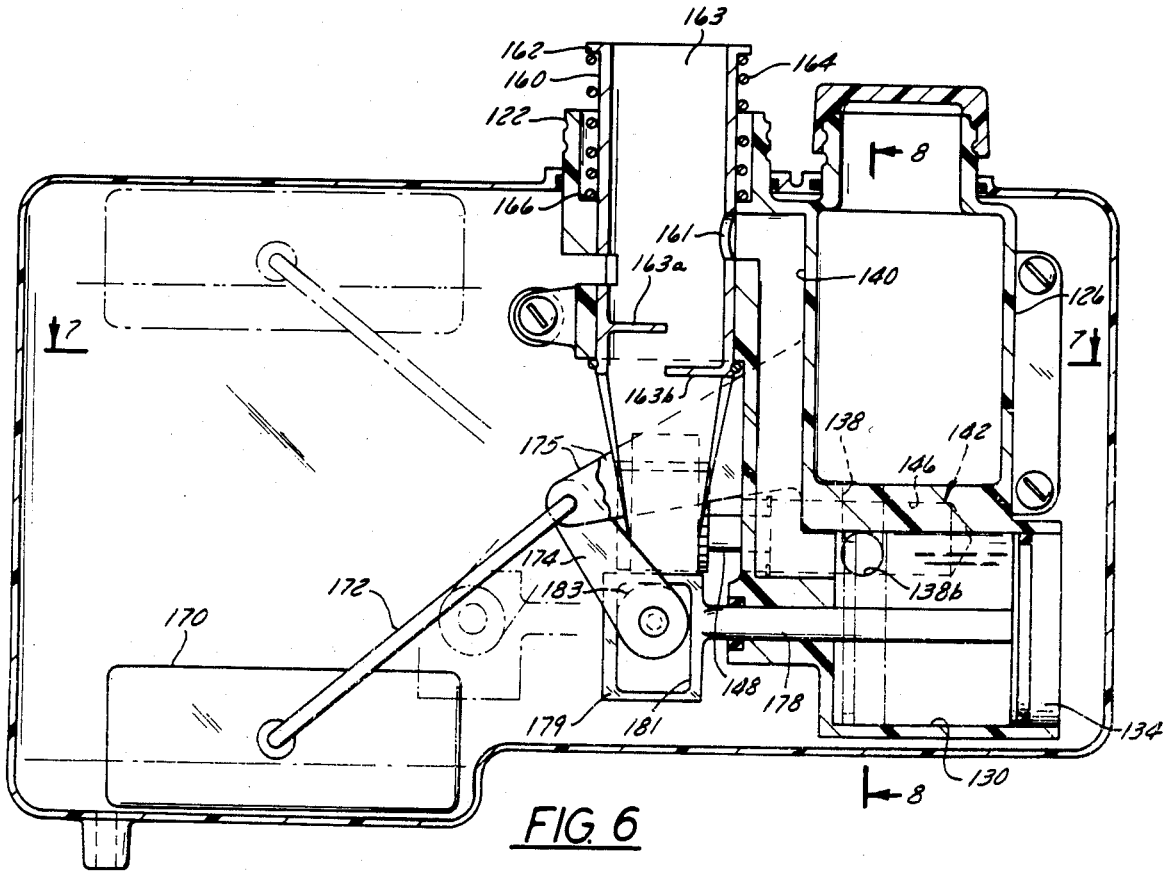
FIG. 6 is a view similar to that of FIG. 5 but showing the fuel tank cap removed and the fuel tank empty.
Figure 7:
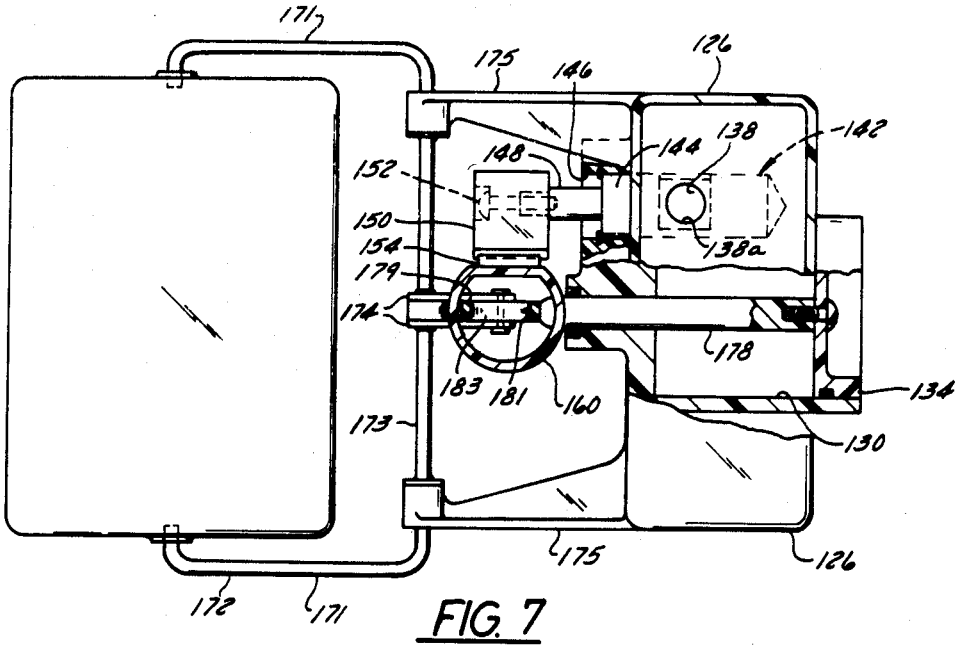
FIG. 7 is a cross section plan view taken generally along line 7—7 in FIG. 6.

In the embodiment of the invention shown in FIGS. 5–9, the sleeve 160 also forms a valve means for selectively permitting oil flow from the metering chamber 130 into the fuel tank 120 to mix with gasoline in the fuel tank. More particularly, the sleeve 160 includes a bore 161 which is aligned with the conduit 140 when the sleeve is in the position shown in FIG. 6 to permit oil flow into the bore 163 and into the fuel tank 120. When the fuel cap 124 is in place as shown in FIG. 5, and the sleeve 160 is forced downwardly to the lowered position, the sleeve 160 closes the conduit 140 and prohibits oil flow into the fuel tank 120.

In the illustrated construction, the sleeve 160 also includes a pair of opposed baffles **163*a* and 163*b* extending inwardly from the walls of the sleeve 160. The baffles 163*a* and 163*b* are provided to cause turbulence of fuel and oil in the bore 163** to thereby cause mixing of the fuel and oil.

Figure 9:
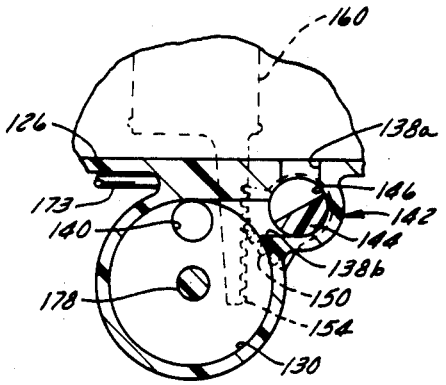
FIG. 9 is a partial vertical cross section view taken along line 9—9 in FIG. 5.
Figure 8:
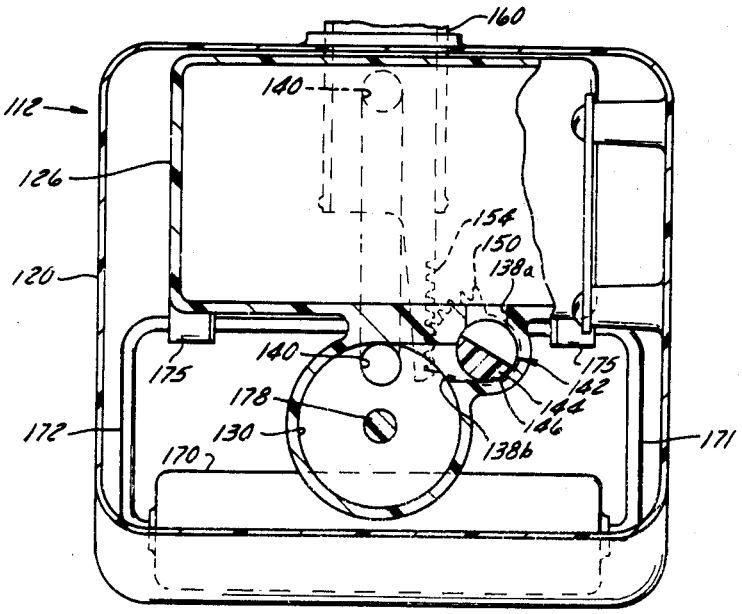
FIG. 8 is a vertical cross section view taken along line 8—8 in FIG. 6.

Means are also provided for causing pivotal movement of the valve member 144 when the fuel tank cap 124 is removed and replaced and to thereby cause the valve member 144 to be positioned as shown at FIG. 9 when the fuel cap 124 is in place to thereby provide for oil flow between the oil reservoir 126 and the metering chamber 130. The means for causing pivotal movement of the valve member 144 also causes movement of the valve member 144 to the position shown in FIG. 8 when the fuel cap 124 is removed and to thereby provide for interruption of the oil flow between the oil reservoir 126 and the metering chamber 130 and free flow of oil from the metering chamber 130 through the conduit 140 to the fuel tank.

In the arrangement shown in FIGS. 5–9 the valve member 144 is supported for rotation by a shaft 148, and a pinion 150 is fixed to the shaft 148 by a screw 152. The lower end of the sleeve 160 is constructed so as to form a rack 154 including teeth adapted to mesh with complementary teeth of the pinion 150 and such that vertical movement of the sleeve 160 in the filler neck 122 will cause rotation of the pinion 150 and the shaft 148 thereby causing consequent rotation of the valve member 144.

Figure 10:
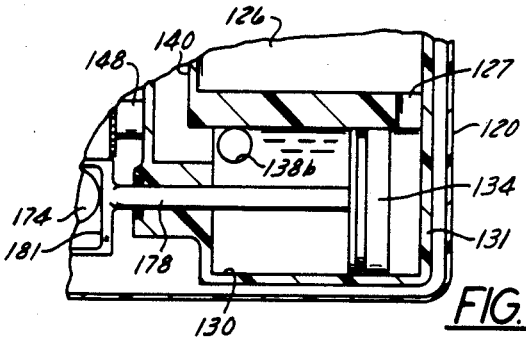
FIG. 10 is a partial view similar to FIGS. 2 and 5 but showing another alternative embodiment of the invention.

FIG. 10 illustrates another alternative embodiment of the invention similar to that shown in FIGS. 5–9. In the embodiment shown in FIG. 10 the cylindrical metering chamber 130 includes an end wall 131 comprising an integral portion of the second container 126. A port 127 provides for free flow of oil between the oil reservoir and the cylindrical metering chamber 130 on one side of the piston 134 while conduit 138 provides for oil flow between the oil reservoir and that portion of the cylindrical metering chamber on the opposite side of the piston 134. By providing oil on both sides of the piston 134, the effect of any leakage past the piston 134 is minimized.

Various features of the invention are set forth in the following claims:

We claim:

1. A fuel tank including a first container means adapted to contain a fuel mixture and including an inlet opening adapted to receive fuel, a second container means adapted to contain a second liquid, and means for selectively delivering a measured quantity of the second liquid from said second container means to said first container means when fuel is added to said first container means, the volume of the second liquid being delivered to said first container means being proportional to the volume of fuel added to said first container means, said means for selectively delivering a measured quantity of said second liquid including means defining a metering chamber and means for alternatively providing fluid communication between said metering chamber and said first container means and between said metering chamber and said second container means.

2. A fuel tank as set forth in claim 1 wherein said means for selectively delivering a measured quantity of said second liquid includes a float housed in said first container means, a piston housed in said metering chamber, and means for operably connecting said float to said piston to cause reciprocal movement of said piston in said metering chamber in response to vertical movement of said float.

3. A fuel tank as set forth in claim 2 wherein said means for operably connecting said float to said piston includes a lever arm having opposite ends, one of said opposite ends being carried by said float and the other of said opposite ends being pivotably supported, a second lever arm fixed to said first lever arm for pivotal movement with said first lever arm, and means for connecting said second lever arm to said piston for causing reciprocal movement of said piston in response to vertical movement of said float.

4. A fuel tank as set forth in claim 1 wherein said means for alternatively providing fluid communication includes valve means including a valve member supported for movement between a first position and a second position and further including a fuel tank cap for removably closing said inlet opening.

5. A fuel tank as set forth in claim 4 and further including means for moving said valve member to said first position when said fuel tank cap closes said inlet opening and means for moving said valve member to said second position when said fuel tank cap is removed from said inlet opening.

6. A fuel tank as set forth in claim 5 wherein said valve means provides fluid communication between said metering chamber and second container means when said valve member is in said first position and providing fluid communication between said metering chamber and said first container means when said valve member is in said second position.

7. A fuel tank as set forth in claim 5 wherein said means for moving said valve member includes a sleeve housed in the inlet opening and supported therein for vertical reciprocal movement between a first position and a second position and spring means compressed between a portion of said sleeve and said first container means, said spring means biasing said sleeve toward said second position.

8. A fuel tank as set forth in claim 7 wherein said valve member is supported for movement with said sleeve and wherein said valve member is in said valve member first position when said sleeve is in the sleeve first position and said valve member is in the valve member second position when the sleeve is in the sleeve second position.

9. A fuel tank as set forth in claim 7 wherein said valve means is a spool valve including a valve spool supported for reciprocal movement, and wherein said valve spool is fixed to said sleeve for movement with said sleeve.

10. A fuel tank as set forth in claim 1 wherein said means for alternatively providing fluid communication includes a first valve means for selectively connecting said metering chamber to said first container means and a second valve means selectively connecting said metering chamber to said container means.

11. A fuel tank as set forth in claim 10 wherein said second valve means comprises a valve member supported for rotation about an axis, and rack and pinion means for causing selective rotation of said valve member.

12. A tank for use in containing a liquid mixture, the tank including a first container means adapted to contain the liquid mixture, the first container means including an inlet opening adapted to receive a first liquid, a second container means being adapted to contain a second liquid, and means for selectively delivering a measured quantity of said second liquid from said second container means to said first container means when the first liquid is added to said first container means, the volume of the second liquid being delivered to said first container means being proportional to the volume of the first liquid added to said first container means, said means for selectively delivering a measured quantity of said second liquid to said first container means including means defining a metering chamber and means for alternatively providing fluid communication between said metering chamber and said first container means and said metering chamber and said second container means.

13. A tank as set forth in claim 12 wherein said means for selectively delivering a measured quantity of said second liquid includes a float housed in said first container means, a piston housed in said metering chamber, and means for operably connecting said float to said piston to cause reciprocal movement of said piston in said metering chamber in response to vertical movement of said float.

14. A tank as set forth in claim 13 and further including a cap for removably closing said inlet opening.

15. A tank as set forth in claim 13 wherein said means for alternatively providing fluid communication includes valve means including a valve member supported for movement between a first position and a second position.

16. A tank as set forth in claim 15 wherein said valve means provides fluid communication between said metering chamber and second container means when said valve member is in said first position and providing fluid communication between said metering chamber and said first container means when said valve member is in said second position.

17. A tank as set forth in claim 15 and further including a cap for removably closing said inlet opening and means for moving said valve member to said first position when said cap closes said inlet opening and means for moving said valve member to said second position when said cap is removed from said inlet opening.

18. A tank as set forth in claim 17 wherein said means for moving said valve member includes a sleeve housed in the inlet opening and supported therein for vertical reciprocal movement between a first position and a second position and spring means compressed between a portion of said sleeve and said first container means and said spring means biasing said sleeve toward said second position.

19. A tank as set forth in claim 18 wherein said valve member is supported for movement with said sleeve and wherein said valve means is in the valve means first position when said sleeve is in the sleeve first position and said valve means is in the valve means second position when the sleeve is in the sleeve second position.

20. A tank as set forth in claim 19 wherein said valve means is a spool valve including a valve spool supported for reciprocal movement and wherein said valve spool is fixed to said sleeve for movement with said sleeve.

21. A tank as set forth in claim 12 wherein said means for alternatively providing fluid communication includes a first valve means for selectively connecting said metering chamber to said first container means and a second valve means selectively connecting said metering chamber to said second container means.

22. A tank as set forth in claim 21 wherein said second valve means comprises a valve member supported for rotation about an axis and rack and pinion means for causing selective rotation of said valve member.

* * * * *